US006939244B1

(12) United States Patent
Shropshire et al.

(10) Patent No.: US 6,939,244 B1
(45) Date of Patent: Sep. 6, 2005

(54) GOLF SWING TRAINING AID

(76) Inventors: Joseph D. Shropshire, P.O. Box 471, Rural Hall, NC (US) 27045; John Fuquay, 1522 Hauser Rd., Lewisville, NC (US) 27023

( * ) Notice: Subject to any disclaimer, the term of this patent is extended or adjusted under 35 U.S.C. 154(b) by 0 days.

(21) Appl. No.: 10/686,125

(22) Filed: Oct. 15, 2003

(51) Int. Cl.[7] ..... A63B 69/36; A63B 53/04

(52) U.S. Cl. ..... 473/235; 473/280; 473/387; 473/349; 473/409; 473/278

(58) Field of Search ..... 473/510–515, 473/329–330, 235, 425, 286, 280, 278, 349, 473/387, 409

(56) References Cited

U.S. PATENT DOCUMENTS

| | | | | | |
|---|---|---|---|---|---|
| 734,752 | A | * | 7/1903 | Ring | 473/510 |
| 1,570,632 | A | * | 1/1926 | Kideney | 473/511 |
| 1,759,622 | A | | 5/1930 | Kenney | |
| 1,877,820 | A | | 9/1932 | Costello | |
| 2,057,821 | A | | 10/1936 | Costello | |
| 2,094,766 | A | | 10/1937 | Costello | |
| 2,157,415 | A | | 5/1939 | Jones | |
| 3,434,722 | A | | 3/1969 | Esposito | |
| 3,708,172 | A | | 1/1973 | Rango | |
| 3,940,145 | A | * | 2/1976 | Gentiluomo | 473/377 |
| 4,149,726 | A | | 4/1979 | Tredway, Sr. | |
| 4,826,173 | A | | 5/1989 | Brown | |
| 5,112,093 | A | * | 5/1992 | Kindling | 294/19.2 |
| 5,156,398 | A | * | 10/1992 | Kibamoto | 473/278 |
| 5,209,485 | A | * | 5/1993 | Nesbitt et al. | 473/372 |
| 5,269,525 | A | * | 12/1993 | Hull et al. | 473/286 |
| 6,077,170 | A | * | 6/2000 | Hawkins | 473/286 |
| 6,334,817 | B1 | * | 1/2002 | Ezawa et al. | 473/324 |
| 6,435,975 | B2 | | 8/2002 | Middleton | |

* cited by examiner

*Primary Examiner*—Sebastiano Passaniti

(57) ABSTRACT

The present invention is a golf swing training apparatus comprising, an elongated shaft having a lower end and an upper end, wherein the upper end includes a handgrip. A club head having a ball striking face, a backside face and a ball-capturing cavity within the club head is attached to the shaft's lower end. The club head's cavity opens to a ball-receiving aperture centered on the ball-striking face, wherein the ball receiving aperture is sized to receive a golf ball sized object, and wherein the ball-capturing cavity is decreasingly tapered such that a golf ball sized object entering the ball-receiving aperture as a result of a proper golf swing will be lodged within the ball-capturing cavity.

16 Claims, 4 Drawing Sheets

GOLF SWING TRAINING AID

BACKGROUND OF THE INVENTION

The present invention relates to a training apparatus used to improve hand and eye coordination during a golf swing. In particular, the present invention relates to a practice golf club having a novel club head useful for indicating whether or not a swing of the golf club is in proper form.

A professional athlete in any sport spends years devoted to practice in order to perfect his or her skills. In the sport of golf, a professional hits thousands of golf balls and plays nearly every day to perfect his or her golf skills, including improving their hand-eye coordination during a golf club swing. Hand-eye coordination is particularly important in the golf swing to ensure proper orientation of the face of the golf club at the point of impact.

Currently, there are many golf club related devices that address various problems pertaining to golf club swing. Some are directed towards swing plane issues, while others are related to strength training. Improvements in these devices are most necessary with regard to the problems associated with hand-eye coordination involving swing plane issues. This need is evidenced by the need for golf professionals to hire swing coaches that follow on tour to constantly correct bad club swing habits inadvertently developed over time. Since the vast majority of golfers cannot afford to hire swing coaches there remains a need for an apparatus useful for improving hand-eye coordination during a golf swing.

SUMMARY OF THE INVENTION

The present invention addresses this need by providing an apparatus to improve hand-eye coordination during a golf swing. In particular, the invention is a practice golf club having a novel club head that captures a practice golf ball as a result of striking the ball with a proper golf swing.

In general, the present invention is a golf swing training apparatus comprising, an elongated shaft having a lower end and an upper end, wherein the upper end includes a hand-grip. A club head having a ball striking face, a backside face and a ball-capturing cavity within the club head is attached to the shaft's lower end. The club head's cavity opens to a ball-receiving aperture centered on the ball-striking face, wherein the ball receiving aperture is sized to receive a golf ball sized object, and wherein the ball-capturing cavity is decreasingly tapered such that a golf ball sized object entering the ball-receiving aperture as a result of a proper golf swing will be lodged within the ball-capturing cavity.

The club head may be made from materials such as metal, wood, and plastics or combinations thereof, as well as composites including fibers and resins. However, the preferred club head material is a generic plastic made up of cross-linked olefinic thermoset polymers based on polydicyclopentadiene (PDCPD) or the like. Such a plastic is currently sold under the trade name Metton and is manufactured by Metton America, which is presently headquartered in Houston, Tex. Applicant has found it to be preferable that the club mimic the size and shape of a standard golf club, and molding the club head for the inventive apparatus from Metton allows the club head to have the appropriate size and weight, while providing sufficient strength to allow for the club to be struck by practice golf balls.

Depending on the material of manufacture, the club head can be molded or machined. In the case of moldable materials, a molding process that includes creating the club head ball-capturing cavity as a molded recess can form the club head. The molded recess is conical shaped with a maximum diameter slightly larger than an officially sized golf ball and a minimum diameter slightly smaller than an officially sized golf ball. Moreover, it is preferred that the club head is molded with a molding process that leaves an opening that extends from inside the ball-capturing cavity to outside the club head backside face. This opening is a pathway for a ball extraction tool.

The ball extraction tool is used to dislodge a practice golf ball captured as the result of a proper golf swing. The tool comprises a handle attached to an elongated rod having a diameter and length sized to traverse the tool pathway such that a captured ball will be dislodged from the ball-capturing cavity whenever a user fully engages the pathway with the length of the extraction tool rod.

If machinable materials are used to make up the club head, traditional machining processes can be used to bore a ball-capturing cavity. In this case, the ball-capturing cavity is a tapered bore recess centered on the ball-striking face of the club head. The bored recess is conical shaped with a maximum diameter slightly larger than an officially sized golf ball and a minimum diameter slightly smaller than an officially sized golf ball. The ball-capturing cavity can be lined with an elastically deformable surface such as a rubber surface to aid ball capture. Moreover, it is preferred that the club head further include a smaller bore that extends from inside the ball-capturing cavity to outside the club head backside face. This smaller bore is a pathway for the elongated rod of the ball extraction tool.

If the club head is manufactured to be a driver, the club head will be designed to weigh between 190 and 210 grams and preferably 196 grams. The club head volume as a driver can be between 300 cc and 500 cc and preferably 400 cc. However, it is important to note that the invention can apply to other clubs such as fairway woods and adaptable to be used with clubs that mimic the weight and of an iron. Therefore, other weight and volume ranges will apply to the club heads of such clubs.

The invention further includes a mat to be used as a practice-playing surface. The mat includes an integral golf tee that is preferably made of rubber. The mat itself can be made of rubber covered with an artificial grass. The area of the mat can be sized to accommodate the feet of a golfer positioned in a swing stance or it can be sized just large enough to maintain the stability of the golf tee.

Moreover, the invention includes a golf ball sized object in the form of a restricted flight practice golf ball made of an elastomeric material. The elastic nature of the ball allows it to deform as it is captured inside the ball-capturing cavity of the club head. The ability of the ball to deform allows the ball to lodge within the cavity rather than rebound free of it.

In operation, a method for teaching a proper golf swing comprises steps of providing the practice golf club having the club head with the ball striking face and the ball-capturing cavity within the club head. Providing the officially sized practice golf ball that will elastically deform as it lodges within the ball-capturing cavity and providing the playing surface with the integral golf tee for holding the practice golf ball within a swing plane of the practice golf club and placing the golf ball on the golf tee. The elongated shaft is preferably a conventional golf shaft, and can have conventional flex and torque characteristics. The grip is similarly of conventional construction. The elastomeric golf ball is placed on a tee. The golfer then uses the club as would be conventionally used. The goal is to swing the club so that the club face contacts the ball with the club face square to the intended swing path. If the club face returns to the ball in such fashion, and in proper orientation, the ball will become lodged in the cavity. If the swing causes the club face to return to the ball improperly, the ball will not enter the cavity. The golfer receives immediate feedback as to the swing fault. It has been found that numerous, correct swings with the inventive apparatus provides the muscle memory necessary to repeat the correct swing when a conventional club is used. The extraction tool provides a means for extracting the golf ball which becomes lodged in the ball capturing cavity so that the swing can be repeated a number of times.

DESCRIPTION OF THE PREFERRED EMBODIMENTS

In the following description it is to be understood that descriptive terms and the like are words of convenience and are not to be construed as limiting terms. It is also to be understood that the illustrations are for the purpose of describing preferred embodiments of the invention and are not intended to limit the invention thereto.

Figure 1:
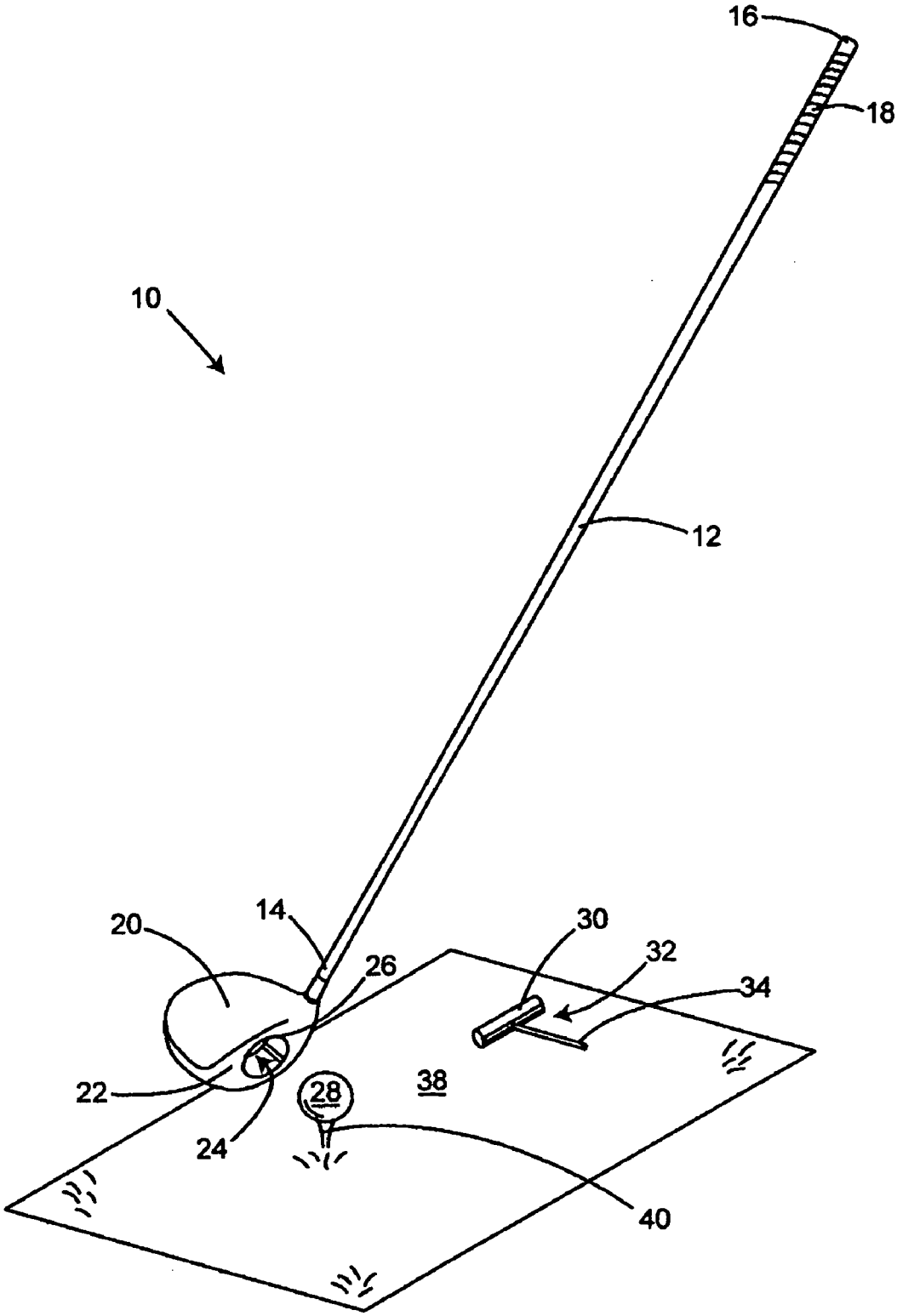
FIG. 1 is a perspective view of the present invention.

Referring to the drawings and first to FIG. 1, a golf swing training apparatus, generally 10 comprises, an elongated shaft 12 having a lower end 14 and an upper end 16. The upper end 16 includes a grip 18 that can be constructed of any conventional material known to those of skill in the art such as leather, rubber or other synthetic. The shaft 12 can be a conventional golf shaft of conventional material and length. Different length shafts could be used if the intended use was with adult males, adult females, or youth golfers. The appropriate length for a particular golfer is well understood by persons of skill in the art. A club head 20 is attached to lower shaft end 14. Club head 20 has a ball striking face 22 and a ball-capturing cavity 24 within club head 20. Club head 20 is preferably designed to mimic the size and weight of a standard golf club, so that the mechanics of the swing are more closely related to the normal golf swing. Club head 20 is preferably designed to be the size and weight of a standard driver since the driver is typically the longest club of a standard set of golf clubs. Thus, being able to practice the hand eye coordination necessary to properly strike the driver should be helpful to the proper striking of other clubs. The club head 20 and shaft 12 can also be sized to be the size and weight of a standard fairway wood, such as a 3-wood or 5-wood. It is also understood that club head 20 can be designed to have the weight of a standard iron club, although the shape might visually be different from a standard club. In such an instance, the shaft 12 would be sized to be the length for that particular club. Cavity 24 opens to a ball-receiving aperture 26 centered on ball-striking face 22. Ball-receiving aperture 26 is sized to receive a golf ball sized object 28.

Figure 2:
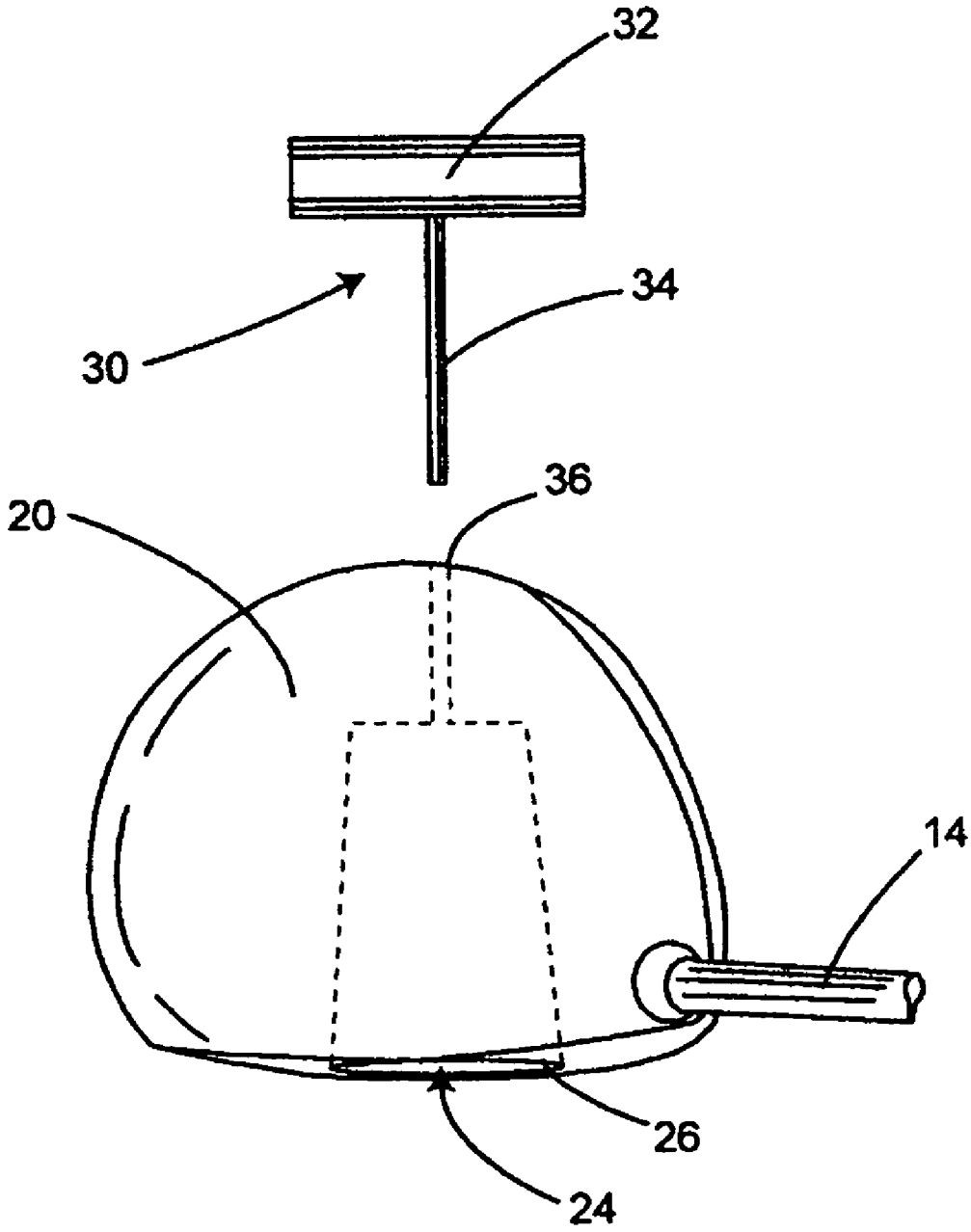
FIG. 2 is a top-view of the club head showing the interior ball-capturing cavity and ball extraction tool.
Figure 3:
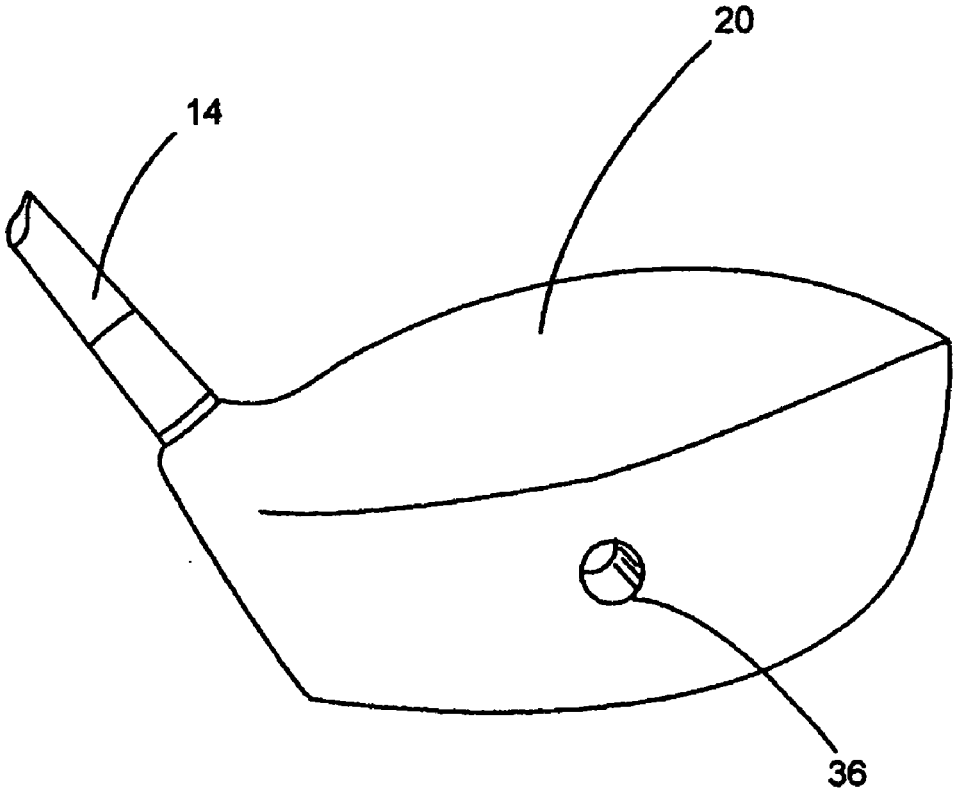
FIG. 3 is a backside view of the club head showing the extraction tool pathway.

FIG. 2 shows a top view of club head 20. As best seen in FIG. 2, ball-capturing cavity 24, outlined by dashed lines, is decreasingly tapered such that golf ball sized object 28 entering ball-receiving aperture 26 as a result of a proper golf swing will be lodged within ball-capturing cavity 24 and can be frictionally retained therein. A ball extractor tool 30 comprises a handle 32 attached to an elongated rod 34. Other structures for the extractor tool 30 are within the scope of the invention. A pathway 36, leads from the interior of ball-capturing cavity 24 to the backside of club head 20 shown in FIG. 3.

Figure 4:
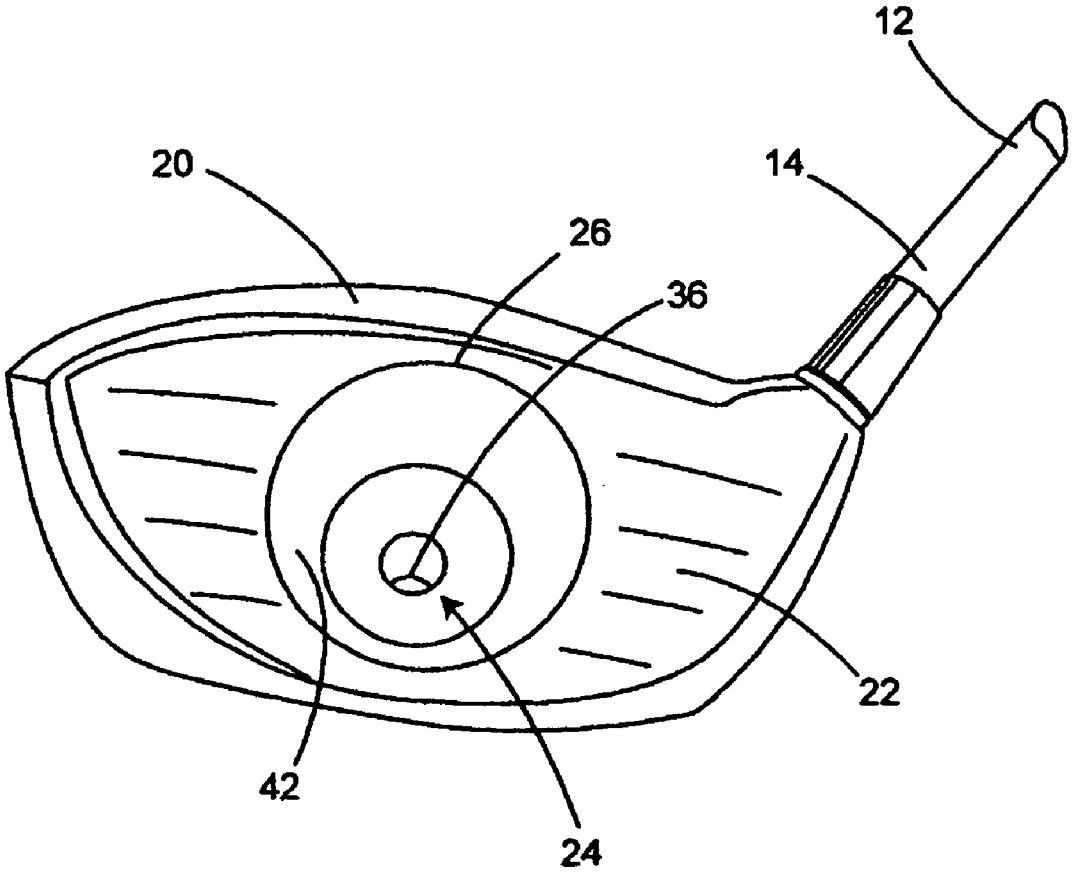
FIG. 4 is a front-side view of the club head showing the ball-capturing cavity.

FIG. 4 shows a detailed front view of club head 20. As can best be seen in FIG. 4, the ball-capturing cavity 24 may be lined with an elastically deformable surface 42.

Turning back to FIG. 1, apparatus 10 further includes a mat 38 having an integral elastic golf tee 40 for holding practice golf ball 28. Ball extractor tool 30 is shown resting on mat 38, but could be carried on the golfer's person during a practice swing.

It will be apparent to one skilled in the art that many modifications and variations can be made to the present invention without departing from its spirit and scope. Therefore, the invention is not to be limited by the description of the preferred embodiment but is to be limited only by the scope of the following claims.

What is claimed is:

1. A golf swing training apparatus for teaching a proper golf swing for hitting a ball having a given diameter, said apparatus comprising:

a) an elongated shaft having a lower end and an upper end, said upper end including a hand grip; and b) a club head attached to said lower shaft end, said club head having a ball striking face, a backside face and a ball-capturing cavity within said club head, said cavity opening to a circular ball-receiving aperture centered on said ball-striking face, wherein said ball receiving aperture has a diameter slightly larger than the given diameter of the ball, and wherein said ball-capturing cavity is decreasingly tapered such that the ball entering said ball-receiving aperture as a result of a proper golf swing will be lodged within said ball-capturing cavity.

2. The apparatus of claim 1, wherein said club head is made from materials including combinations thereof selected from the group consisting of metal, wood and plastics.

3. The apparatus of claim 1, wherein said apparatus has a club head weight between 190 and 210 grams.

4. The apparatus of claim 1, wherein said apparatus has a club head volume between 300 cc and 500 cc.

5. The apparatus of claim 1, wherein said ball-capturing cavity is a molded recess.

6. The apparatus of claim 1, wherein said ball-capturing cavity is a conical bore.

7. The apparatus of claim 1, further including a practice golf ball that will elastically deform as it lodges within said ball-capturing cavity.

8. The apparatus of claim 7, wherein said practice golf ball is a restricted flight ball made of an elastomeric material.

9. The apparatus of claim 1, further including an elastically deformable surface that lines said ball-capturing cavity.

10. The apparatus of claim 1, further including a mat having an integral elastic golf tee for holding a practice golf ball.

11. The apparatus of claim 10, wherein said mat is made of artificial grass.

12. The apparatus of claim 10, wherein said elastic golf tee is made of rubber.

13. The apparatus of claim 1, further including a ball extraction tool for removing a practice golf ball lodged within said ball-capturing cavity.

14. The apparatus of claim 13, wherein said ball extraction tool is made from an elongated rod that inserts through an opening through said club head into said ball-capturing cavity.

15. The apparatus of claim 14, wherein said opening is a bore extending from said club head backside face into said ball-capturing cavity.

16. A method for teaching a proper golf swing, said method comprising steps of:

providing a practice golf ball having a given diameter that will elastically deform as it lodges within said ball-capturing cavity;

providing a practice golf club having a club head with a ball striking face and a ball-capturing cavity within said club head, said ball-capturing cavity opening to a circular aperture centered on said ball-striking face, wherein said circular aperture has a diameter slightly larger than the given diameter of said practice golf ball and wherein said ball-capturing cavity is decreasingly tapered such that said practice golf ball entering said ball-receiving aperture will be captured within said ball-capturing cavity;

providing a playing surface with a properly set golf tee for holding said golf ball within a swing plane of said practice golf club;

placing said golf ball on said golf tee; and swinging said golf club in an attempt to strike said practice golf ball with the center of said club head striking surface such that said practice golf ball is captured within said ball-capturing cavity.

* * * * *